US008891778B2

(12) United States Patent
Brown

(10) Patent No.: US 8,891,778 B2
(45) Date of Patent: Nov. 18, 2014

(54) SPEECH ENHANCEMENT

(75) Inventor: C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1128 days.

(21) Appl. No.: 12/676,410

(22) PCT Filed: Sep. 10, 2008

(86) PCT No.: PCT/US2008/010591

§ 371 (c)(1),
(2), (4) Date: Mar. 4, 2010

(87) PCT Pub. No.: WO2009/035615

PCT Pub. Date: Mar. 19, 2009

(65) Prior Publication Data

US 2010/0179808 A1 Jul. 15, 2010

Related U.S. Application Data

(60) Provisional application No. 60/993,601, filed on Sep. 12, 2007.

(51) Int. Cl.

| | |
|---|---|
| ***H04R 5/00*** | (2006.01) |
| ***G10L 21/02*** | (2013.01) |
| ***G10L 21/0208*** | (2013.01) |

(52) U.S. Cl.

CPC ..... *G10L 21/02* (2013.01); *G10L 21/0208* (2013.01)

USPC ..... 381/27; 381/26; 381/103; 381/119; 381/107; 704/225; 704/233

(58) Field of Classification Search

CPC ..... H04S 3/006; H04S 3/008; H04S 5/02; H04S 2400/05; G10L 25/81; G10L 25/87; G10L 25/93; G10L 21/0264; G10L 21/0216; G10L 21/0224; G10L 21/0232

USPC ..... 381/1, 2, 10, 13, 17, 18, 19, 20, 22, 381/307, 309, 310, 311, 27, 28, 54, 57, 61, 381/63, 321, 320, 71.11, 71.12, 71.14, 80, 381/82, 83, 84, 94.2, 94.3, 94.4, 94.8, 97, 381/98, 99, 100, 101, 102, 103, 104, 106, 381/107, 110, 119, 120, 26; 704/200.1, 704/202, 204, 205, 207, 208, 210, 214, 215, 704/216, 217, 218, 225, 233, 236, 237, 240, 704/246, 232; 700/94

See application file for complete search history.

(56) References Cited

U.S. PATENT DOCUMENTS

| | | | | |
|---|---|---|---|---|
| 5,201,005 | A * | 4/1993 | Matsushita et al. | 381/63 |
| 6,732,073 | B1 | 5/2004 | Kluender et al. | |

(Continued)

FOREIGN PATENT DOCUMENTS

| | | |
|---|---|---|
| CN | 1409577 | 9/2003 |
| JP | H06-205500 | 7/1994 |

(Continued)

OTHER PUBLICATIONS

Jot, J.M., et al., "Spatial Enhancement of Audio Recordings", Proceedings of the Intl AES Conference, May 23, 2003, pp. 1-11.

(Continued)

*Primary Examiner* — Leshui Zhang

(57) ABSTRACT

A method for enhancing speech includes extracting a center channel of an audio signal, flattening the spectrum of the center channel, and mixing the flattened speech channel with the audio signal, thereby enhancing any speech in the audio signal. Also disclosed are a method for extracting a center channel of sound from an audio signal with multiple channels, a method for flattening the spectrum of an audio signal, and a method for detecting speech in an audio signal. Also disclosed is a speech enhancer that includes a center-channel extract, a spectral flattener, a speech-confidence generator, and a mixer for mixing the flattened speech channel with original audio signal proportionate to the confidence of having detected speech, thereby enhancing any speech in the audio signal.

7 Claims, 4 Drawing Sheets

(56) References Cited

U.S. PATENT DOCUMENTS

| | | | | |
|---|---|---|---|---|
| 6,993,480 | B1 | 1/2006 | Klayman | |
| 7,191,122 | B1 | 3/2007 | Gao et al. | |
| 2003/0055636 | A1* | 3/2003 | Katuo et al. | 704/225 |
| 2003/0161479 | A1 | 8/2003 | Yang et al. | |
| 2006/0206320 | A1 | 9/2006 | Li | |
| 2007/0041592 | A1 | 2/2007 | Avendano et al. | |
| 2007/0094017 | A1 | 4/2007 | Zinser, Jr. et al. | |

FOREIGN PATENT DOCUMENTS

| | | | |
|---|---|---|---|
| JP | H06-253398 | | 9/1994 |
| JP | 07-307997 | | 11/1995 |
| JP | 2003-084790 | | 3/2003 |
| JP | 2005-258158 | | 9/2005 |
| JP | 2007-517249 | | 6/2007 |
| WO | 03/015082 | A1 | 2/2003 |
| WO | 03/022003 | A2 | 3/2003 |
| WO | 2004/013840 | A1 | 7/2003 |
| WO | 2004/049759 | A1 | 6/2004 |

OTHER PUBLICATIONS

Intl Searching Authority, "Notification of Transmittal of the Intl Search Report and the Written Opinion of the Intl Searching Authority, or the Declaration", dated Nov. 2, 2009 for Intl Application No. PCT/US2008/010591.

Schaub, A., et al., "Spectral sharpening for speech enhancement noise reduction", Proc. ICASSP 1991, Toronto, Canada, May 1991, pp. 993-996.

Sondhi, M., "New methods of pitch extraction", Audio and Electroacoustics, IEEE Transactions, Jun. 1968, vol. 16, Issue 2, pp. 262-266.

Villchur, E., "Signal Processing to Improve Speech Intelligibility for the Hearing Impaired", 99th Audio Engineering Society Convention, Sep. 1995.

Thomas, I., et al., "Preprocessing of Speech for Added Intelligibility in High Ambient Noise", 34th Audio Engineering Society Convention, Mar. 1968.

Moore, B., et al., "A Model for the Prediction of Thresholds, Loudness, and Partial Loudness", J. Audio Eng. Soc., vol. 45, No. 4, Apr. 1997.

Moore, B., et al., "Psychoacoustic consequences of compression in the peripheral auditory system", The Journal of the Acoustical Society of America, Dec. 2002, vol. 112, Issue 6, pp. 2962-296.

Sallberg, B., et al., "Analog Circuit Implementation for Speech Enhancement Purposes Signals", Systems and Computers, 2004, Conf. Record of the Thirty-Eighth Asilomar Conference.

Magotra, N., et al., "Real-time digital speech processing strategies for the hearing impaired", Acoustics, Speech, and Signal Processing, ICASSP-97, 1997, vol. 2, pp. 1211-1214.

Walker, G., et al., "The effects of multichannel compression/expansion amplification on the intelligibility of nonsense syllables in noise", The Journal of the Acoustical Society of America, Sep. 1984, vol. 76, Issue 3, pp. 746-757.

Vinton, M., et al., Automated Speech/Other Discrimination for Loudness Monitoring, AES 118th Convention, 2005.

Scheirer, E., et al., "Construction and evaluation of a robust multifeature speech/music/discriminator", IEEE Transactions on Acoustics, Speech, and Signal Processing (ICASSP97), Jan. 3, 1997, pp. 1331-1334.

* cited by examiner

SPEECH ENHANCEMENT

DISCLOSURE OF THE INVENTION

Herein are described methods and apparatus for extracting a center channel of sound from an audio signal with multiple channels, for flattening the spectrum of an audio signal, for detecting speech in an audio signal and for enhancing speech. A method for extracting a center channel of sound from an audio signal with multiple channels may include multiplying (1) a first channel of the audio signal, less a proportion $\alpha$ of a candidate center channel and (2) a conjugate of a second channel of the audio signal, less the proportion $\alpha$ of the candidate center channel, approximately minimizing $\alpha$ and creating the extracted center channel by multiplying the candidate center channel by the approximately minimized $\alpha$.

A method for flattening the spectrum of an audio signal may include separating a presumed speech channel into perceptual bands, determining which of the perceptual bands has the most energy and increasing the gain of perceptual bands with less energy, thereby flattening the spectrum of any speech in the audio signal. The increasing may include increasing the gain of perceptual bands with less energy, up to a maximum.

A method for detecting speech in an audio signal may include measuring spectral fluctuation in a candidate center channel of the audio signal, measuring spectral fluctuation of the audio signal less the candidate center channel and comparing the spectral fluctuations, thereby detecting speech in the audio signal.

A method for enhancing speech may include extracting a center channel of an audio signal, flattening the spectrum of the center channel and mixing the flattened speech channel with the audio signal, thereby enhancing any speech in the audio signal. The method may further include generating a confidence in detecting speech in the center channel and the mixing may include mixing the flattened speech channel with the audio signal proportionate to the confidence of having detected speech. The confidence may vary from a lowest possible probability to a highest possible probability, and the generating may include further limiting the generated confidence to a value higher than the lowest possible probability and lower than the highest possible probability. The extracting may include extracting a center channel of an audio signal, using the method described above. The flattening may include flattening the spectrum of the center channel using the method described above. The generating may include generating a confidence in detecting speech in the center channel, using the method described above.

The extracting may include extracting a center channel of an audio signal, using the method described above; the flattening may include flattening the spectrum of the center channel using the method described above; and the generating may include generating a confidence in detecting speech in the center channel, using the method described above.

Herein is taught a computer-readable storage medium wherein is located a computer program for executing any of the methods described above, as well as a computer system including a CPU, the storage medium and a bus coupling the CPU and the storage medium.

BEST MODE FOR CARRYING OUT THE INVENTION

Figure 1:
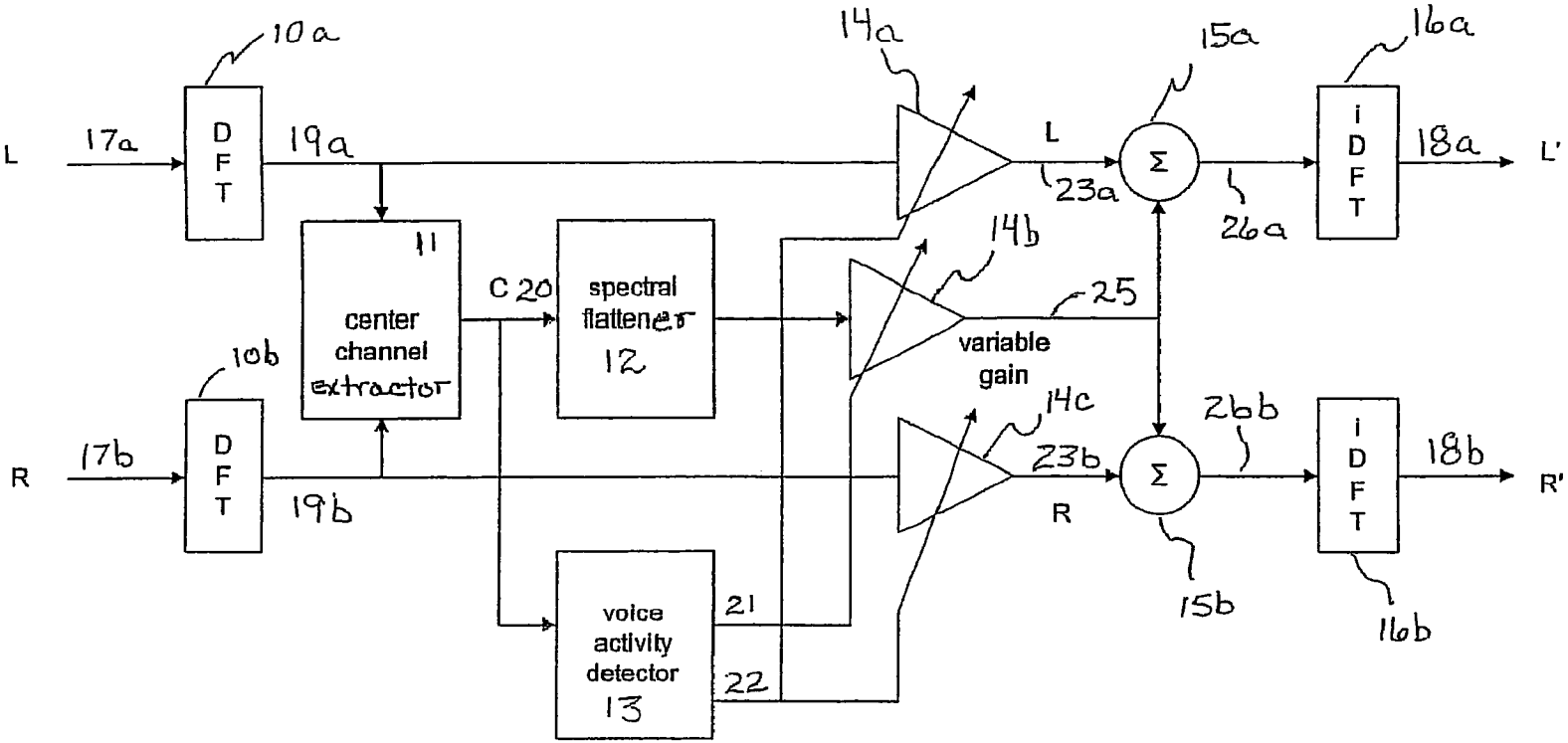
FIG. 1 is a functional block diagram of a speech enhancer according to one embodiment of the invention.

FIG. 1 is a functional block diagram of a speech enhancer 1 according to one embodiment of the invention. The speech enhancer 1 includes an input signal 17, Discrete Fourier Transformers 10*a*, 10*b*, a center-channel extractor 11, a spectral flattener 12, a voice activity detector 13, variable-gain amplifiers 15*a*, 15*c*, inverse Discrete Fourier Transformers 18*a*, 18*b* and the output signal 18. The input signal 17 consists of left and right channels 17*a*, 17*b*, respectively, and the output signal 18 similarly consists of left and right channels 18*a*, 18*b*, respectively.

Respective Discrete Fourier Transformers 18 receives the left and right channels 17*a*, 17*b* of the input signal 17 as input and produces as output the transforms 19*a*, 19*b*. The center-channel extractor 11 receives the transforms 19 and produces as output the phantom center channel C 20. The spectral flattener 12 receives as input the phantom center channel C 20 and produces as output the shaped center channel 24, while the voice activity detector 13 receives the same input C 20 and produces as output the control signal 22 for variable-gain amplifiers 14*a* and 14*c* on the on hand and, on the other, the control signal 21 for variable-gain amplifier 14*b*.

The amplifier 14*a* receives as input and control signal the left-channel transform 19*a* and the output control signal 22 of the voice activity detector 13, respectively. Likewise, the amplifier 14*c* receives as input and control signal the right-channel transform 19*b* and the voice-activity-detector output control signal 22, respectively. The amplifier 14*b* receives as input and control signal the spectrally shaped center channel 24 and the output voice-activity-detector control signal 21 of the spectral flattener 12.

The mixer 15*a* receives the gain-adjusted left transform 23*a* output from the amplifier 14 and the gain-adjusted spectrally shaped center channel 25 and produces as output the signal 26*a*. Similarly, the mixer 15*b* receives the gain-adjusted right transform 23*b* from the amplifier 14*c* and the gain-adjusted spectrally shaped center channel 25 and produces as output the signal 26*b*.

Inverse transformers 18*a*, 18*b* receive respective signals 26*a*, 26*b* and produce respective derived left- and right-channel signals L' 18*a*, R' 18*b*.

The operation of the speech enhancer 1 is described in more detail below. The processes of center-channel extraction, spectral flattening, voice activity detection and mixing, according to one embodiment, are described in turn—first in rough summary, then in more detail.

Center-Channel Extraction

The assumptions are as follow:

(1) The signal of interest 17 contains speech.

(2) In the case of a multi-channel signal (i.e., left and right, or stereo), the speech is center panned.

(3) The true panned center consists of a proportion alpha ($\alpha$) of the source left and right signals.

(4) The result of subtracting that proportion is a pair of orthogonal signals,

Operating on these assumptions, the center-channel extractor 11 extracts the center-panned content C 20 from the stereo signal 17. For center-panned content, identical regions of both left and right channels contain that center-panned content. The center-panned content is extracted by removing the identical portions from both the left and right channels.

One may calculate LR*=0 (where * indicates the conjugate) for the remaining left and right signals (over a frame of blocks or using a method that continually updates as a new block enters) and adjust a proportion α until that quantity is sufficiently near zero.

Spectral Flattening

Auditory filters separate the speech in the presumed speech channel into perceptual bands. The band with the most energy is determined for each block of data. The spectral shape of the speech channel for that block is then altered to compensate for the lower energy in the remaining bands. The spectrum is flattened: Bands with lower energies have their gains increased, up to some maximum. In one embodiment, all bands may share a maximum gain. In an alternate embodiment, each band may have its own maximum gain. (In the degenerate case where all of the bands have the same energy, then the spectrum is already flat. One may consider the spectral shaping as not occurring, or one may consider the spectral shaping as achieved with identity functions.)

The spectral flattening occurs regardless of the channel content. Non-speech may be processed but is not used later in the system. Non-speech has a very different spectrum than speech, and so the flattening for non-speech is generally not the same as for speech.

Voice Activity Detector

Once the assumed speech is isolated to a single channel, it is analyzed for speech content. Does it contain speech? Content is analyzed independent of spectral flattening. Speech content is determined by measuring spectral fluctuations in adjacent frames of data. (Each frame may consist of many blocks of data, but a frame is typically two, four or eight blocks at a 48 kHz sample rate.)

Where the speech channel is extracted from stereo, the residual stereo signal may assist with the speech analysis. This concept applies more generally to adjacent channels in any multi-channel source.

Mixing

When speech is deemed present, the flattened speech channel is mixed with the original signal in some proportion relative to the confidence that the speech channel indeed contains speech. In general, when the confidence is high, more of the flattened speech channel is used. When confidence is low, less of the flattened speech channel is used.

The processes of center-channel extraction, spectral flattening, voice activity detection and mixing, according to one embodiment, are described in turn in more detail.

Extraction of Phantom Center and Surround Channels from 2-Channel Sources

With speech enhancement, one desires to extract, process and re-insert only the center panned audio. In a stereo mix, speech is most often center panned.

The extraction of center panned audio (phantom center channel) from a 2-channel mix is now described. A mathematical proof composes a first part. The second part applies the proof to a real-world stereo signal to derive the phantom center.

When the phantom center is subtracted from the original stereo, a stereo signal with orthogonal channels remains. A similar method derives a phantom surround channel from the surround-panned audio.

Center Channel Extraction—Mathematical Proof

Given some two-channel signal, one may separate the channels into left (L) and right (R). The left and right channels each contains unique information, as well as common information. One may represent the common information as C (center panned), and the unique information as L and R—left only and right only, respectively.

$$L=L+C$$

$$R=R+C \tag{1}$$

"Unique" implies that L and R are orthogonal to each other:

$$LR^*=0 \tag{2}$$

If one separates L and R into real and imaginary parts, $$L_rR_r+L_iR_i=0 \tag{3}$$

where $L_r$ is the real part of L, $L_i$ is the imaginary part of L, and similarly for R.

Now assume that the orthogonal pair (L and R) is created from the non-orthogonal pair (L and R) by subtracting the center panned C from L and R.

$$L=L-C \tag{4}$$

$$R=R-C \tag{5}$$

Now let C=αC, where C is an assumed center channel and α is a scaling factor:

$$L=L-\alpha C \tag{6}$$

$$R=R-\alpha C \tag{7}$$

Substituting Equations (6) and (7) into Equation (3):

$$\begin{aligned} L_rR_r + L_iR_i &= (L_r - \alpha C_r)(R_r - \alpha C_r) + (L_i - \alpha C_i)(R_i - \alpha C_i) \\ &= L_rR_r - \alpha C_r(L_r + R_r) + \alpha^2 C_r^2 + L_iR_i - \\ &\quad \alpha C_i(L_i + R_i) + \alpha^2 C_i^2 \\ &= \alpha^2[C_r^2 + C_i^2] + \alpha[-C_r(L_r + R_r) - C_i(L_i + R_i)] + \\ &\quad [L_rR_r + L_iR_i] \\ &= 0 \end{aligned} \tag{8}$$

Equation (8) is in the form of the quadratic equation:

$$\alpha^2X+\alpha Y+Z=0 \tag{9}$$

where the roots are found by:

$$\alpha = \frac{-Y \pm \sqrt{Y^2 - 4XZ}}{2X} \tag{10}$$

Now let the assumed C in Equations (6) and (7) be as follows:

$$C=L+R \tag{11}$$

Separating into real and imaginary:

$$C_r=L_r+R_r \tag{12}$$

$$C_i=L_i+R_i \tag{13}$$

Then in the quadratic Equation (9):

$$X=C_r^2+C_i^2=(L_r+R_r)^2+(L_i+R_i)^2 \tag{14}$$

$$Y=-C_r(L_r+R_r)-C_i(L_i+R_i)=-(L_r+R_r)^2-(L_i+R_i)^2=-X \tag{15}$$

$$Z=L_rR_r+L_iR_i \tag{16}$$

Substituting Equations (14), (15) and (16) into Equation (10) and solving for a:

$$\begin{aligned}\alpha &= \frac{-Y \pm \sqrt{Y^2 - 4XZ}}{2X} \\ &= \frac{X \pm \sqrt{X^2 - 4XZ}}{2X} \\ &= \frac{1 \pm \sqrt{1 - 4\frac{Z}{X}}}{2} \\ &= \frac{1 \pm \sqrt{1 - 4\frac{L_r R_r + L_i R_i}{(L_r + R_r)^2 + (L_i + R_i)^2}}}{2} \\ &= \frac{1}{2} \times \left[1 \pm \sqrt{\frac{(L_r - R_r)^2 + (L_i - R_i)^2}{(L_r + R_r)^2 + (L_i + R_i)^2}}\right]\end{aligned} \tag{17}$$

Choosing the negative root for the solution to α and limiting a to the range of {0, 0.5} avoid confusion with surround panned information (although the values are not critical to the invention). The phantom center channel equation then becomes:

$$\begin{aligned}C &= \alpha C = \alpha(L + R) \\ &= \alpha[(L_r + R_r) + \sqrt{-1}\,(L_i + R_i)]\end{aligned} \tag{18}$$

where $$\alpha = \min\left\{\max\left\{0, \frac{1}{2} \times \left[1 - \sqrt{\frac{(L_r - R_r)^2 + (L_i - R_i)^2}{(L_r + R_r)^2 + (L_i + R_i)^2}}\right]\right\}, 0.5\right\} \tag{19}$$

(The min{ } and max{ } functions limit α to the range of {0, 0.5}, although the values are not critical to the invention . . . )

A phantom surround channel can similarly be derived as:

$$\begin{aligned}S &= \beta S = \beta(L - R) \\ &= \beta\left[(L_r - R_r) + \sqrt{-1}\,(L_i - R_i)\right]\end{aligned} \tag{20}$$

$$\beta = \min\left\{\max\left\{0, \frac{1}{2} \times \left[1 - \sqrt{\frac{(L_r + R_r)^2 + (L_i + R_i)^2}{(L_r - R_r)^2 + (L_i - R_i)^2}}\right]\right\}, 0.5\right\} \tag{21}$$

where S is the surround panned audio in the original stereo pair (L, R) and S is the assumed to be (L−R). Again, choosing the negative root for the solution to β and limiting β to the range of {0, 0.5} avoid confusion with center panned information (although the values are not critical to the invention).

Now that C and S have been derived, they can be removed from the original stereo pair (L and R) to make four channels of audio from the original two:

$$L' = L - C - S \tag{22}$$

$$R' = R - C + S \tag{23}$$

where L' is the derived left, C the derived center, R' the derived right and S derived surround channels.

Center Channel Extraction—Application

As stated above, for the speech enhancement method, the primary concern is the extraction of the center channel. In this part, the technique described above is applied to a complex frequency domain representation of an audio signal.

The first step in extraction of the phantom center channel is to perform a DFT on a block of audio samples and obtain the resulting transform coefficients. The block size of the DFT depends on the sampling rate. For example, at a sampling rate fs of 48 kHz, a block size of N=512 samples would be acceptable. A windowing function w[n] such as a Hamming window weights the block of samples prior to application of the transform:

$$w[n] = 0.5\left(1 - \cos\left(\frac{2\pi n}{N - 1}\right)\right) \quad 0 \le n < N \tag{24}$$

where n is an integer, and N is the number of samples in a block.

Equation (25) calculates the DFT coefficients as:

$$X_m[k, c] = \sum_{n=0}^{N-1} x[mN + n, c]w[n]e^{\frac{-j2\pi kn}{N}} \quad \begin{matrix} 0 \le k < N \\ 1 \le c \le 3 \end{matrix} \tag{25}$$

where x[n,c] is sample number n in channel c of block m,j is the imaginary unit ($j^2=-1$), and $X_m[k,c]$ is transform coefficient kin channel c for samples in block m. Note that the number of channels is three: left, right and phantom center (in the case of x[n,c], only left and right). In the equations below, the left channel is designated as c=1, the phantom center as c=2 (not yet derived) and the right channel as c=3. Also, the Fast Fourier Transform (FFT) can efficiently implement the DFT.

The sum and difference of left and right are found on a per-frequency-bin basis. The real and imaginary parts are grouped and squared. Each bin is then smoothed in-between blocks prior to calculating α. The smoothing reduces audible artifacts that occur when the power in a bin changes too rapidly between blocks of data. Smoothing may be done by, for example, leaky integrator, non-linear smoother, linear but multi-pole low-pass smoother or even more elaborate smoother.

$$B_m(k)_{diff} = (Re\{X_m[k,1]\} - Re\{X_m[k,3]\})^2 + (Im\{X_m[k,1]\} - Im\{X_m[k,3]\})^2 \tag{26a}$$

$$B_m(k)_{sum} = (Re\{X_m[k,1]\} + Re\{X_m[k,3]\})^2 + (Im\{X_m[k,1]\} + Im\{X_m[k,3]\})^2 \tag{26b}$$

$$B_{temp} = \lambda_1 B_{m-1}(k)_{diff} + (1 - \lambda_1)B_m)B_m(k)_{diff}$$

$$B_m(k)_{diff} = B_{temp} 0 << \lambda_1 < 1 \tag{26c}$$

$$B_{temp} = \lambda_1 B_{m-1}(k)_{sum} + (1 - \lambda_1)B_m(k)_{sum}$$

$$B_m(k)_{diff} = B_{temp} 0 << \lambda_1 < 1 \tag{26d}$$

where Re{ } is the real part, Im{ } is the imaginary part, and $\lambda_1$ is a leaky integrator coefficient. The leaky integrator has a low pass filtering effect, and a typical value for $\lambda_1$ is 0.9. The extraction coefficient α for block m is then derived using Equation (19):

$$\alpha_m(k) = \min\left\{\max\left\{0, \frac{1}{2} \times \left[1 - \sqrt{\frac{E_m(k)_{diff}}{E_m(k)_{sum}}}\right]\right\}, 0.5\right\} \tag{27}$$

The phantom center channel for block m is then derived using Equation (18):

$$X_m[k,2]=\alpha_m(k)(X_m[k,1]+X_m[k,3]) \tag{28}$$

Spectral Flattening

A description of an embodiment of the spectral flattening of the invention follows. Assuming a single channel that is predominantly speech, the speech signal is transformed into the frequency domain by the Discrete Fourier Transform (DFT) or a related transform. The magnitude spectrum is then transformed into a power spectrum by squaring the transform frequency bins.

Figure 2:
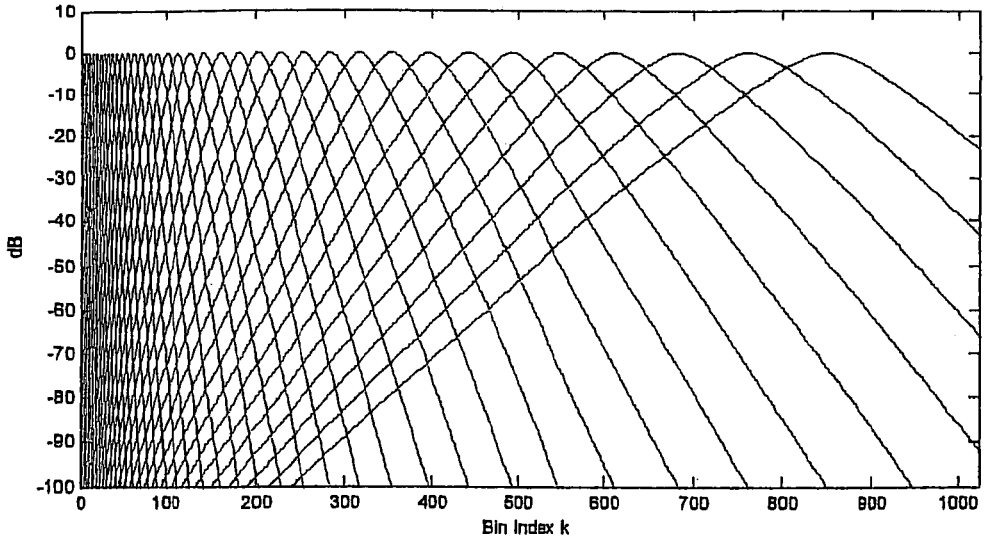
FIG. 2 depicts a suitable set of filters with a spacing of 1 ERB, resulting in a total of 40 bands.

The frequency bins are then grouped into bands possibly on a critical or auditory-filter scale. Dividing the speech signal into critical bands mimics the human auditory system—specifically the cochlea. These filters exhibit an approximately rounded exponential shape and are spaced uniformly on the Equivalent Rectangular Bandwidth (ERB) scale. The ERB scale is simply a measure used in psychoacoustics that approximates the bandwidth and spacing of auditory filters. FIG. 2 depicts a suitable set of filters with a spacing of 1 ERB, resulting in a total of 40 bands. Banding the audio data also helps eliminate audible artifacts that can occur when working on a per-bin basis. The critically banded power is then smoothed with respect to time, that is to say, smoothed across adjacent blocks.

Figure 3:
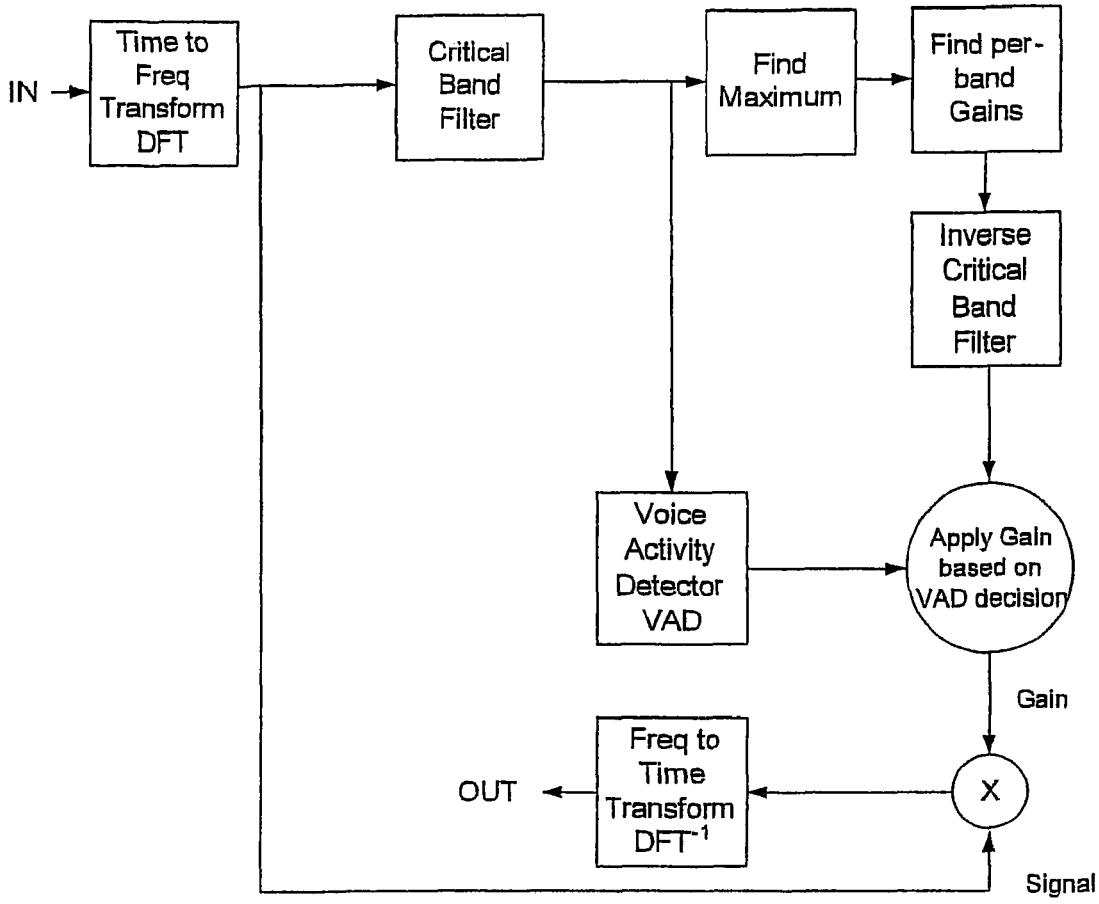
FIG. 3 describes the mixing process according to one embodiment of the invention.

The maximum power among the smoothed critical bands is found and corresponding gains are calculated for the remaining (non-maximum) bands to bring their power closer to the maximum power. The gain compensation is similar to the compressive (non-linear) nature of the basilar membrane. These gains are limited to a maximum to avoid saturation. In order to apply these gains to the original signal, they must be transformed back to a DFT format. Therefore, the per-band power gains are first transformed back into frequency bin power gains, then per-bin power gains are then converted to magnitude gains by taking the square root of each bin. The original signal transform bins can then be multiplied by the calculated per-bin magnitude gains. The spectrally flattened signal is then transformed from the frequency domain back into the time domain. In the case of the phantom center, it is first mixed with the original signal prior to being returned to the time domain. FIG. 3 describes this process.

The spectral flattening system described above does not take into account the nature of input signal. If a non-speech signal was flattened, the perceived change in timbre could be severe. In order to avoid the processing of non-speech signals, the method described above can be coupled with a voice activity detector 13. When the voice activity detector 13 indicates the presence of speech, the flattened speech is used.

It is assumed that the signal to be flattened has been converted to the frequency domain as previously described. For simplicity, the channel notation used above has been omitted. The DFT coefficients are converted to power, and then from the DFT domain to critical bands $$C_m[p] = \sum_{k=0}^{N-1} H[k,\ p]|X_m[k]|^2 \tag{29}$$

$$0 \le p < P$$

where H[k,p] are P critical band filters.

The power in each band is then smoothed in-between blocks, similar to the temporal integration that occurs at the cortical level of the brain. Smoothing may be done by, for example, leaky integrator, non-linear smoother, linear but multi-pole low-pass smoother or even more elaborate smoother. This smoothing also helps eliminate transient behavior that can cause the gains to fluctuate too rapidly between blocks, causing audible pumping. The peak power is then found.

$$E_m[p] = \lambda_2 E_{m-1}[p] + (1-\lambda_2)C_m[p] \tag{30a}$$

$$0 << \lambda_2 < 1$$

$$E_{max} = \max_p \{E_m[p]\} \tag{30b}$$

where $E_m[p]$ is the smoothed, critically banded power, $\lambda_2$ is the leaky-integrator coefficient, and $E_{max}$ is the peak power. The leaky integrator has a low-pass-filtering effect, and again, a typical value for $\lambda_2$ is 0.9.

The per-band power gains are next found, with the maximum gain constrained to avoid overcompensating:

$$G_m[p] = \min\left\{\left(\frac{E_{max}}{E[p]}\right)^{\gamma},\ G_{max}\right\} \tag{31a}$$

$$0 < \gamma < 1 \tag{31b}$$

where $G_m[p]$ is the power gain to be applied to each band, $G_{max}$ is the maximum power gain allowable, and $\gamma$ determines the degree of leveling of the spectrum. In practice, $\gamma$ is close to unity. $G_{max}$ depends on the dynamic range (or headroom) if the system performing the processing, as well as any other global limits on the amount of gain specified. A typical value for $G_{max}$ is 20 dB.

The per-band power gains are next converted to per-bin power, and the square root is taken to get per-bin magnitude gains:

$$Y_m[k] = \sum_{p=0}^{P-1} [G_m[p]H[k,\ p]]^{1/2} \tag{32}$$

$$0 \le k < K$$

where $Y_m[k]$ is the per-bin magnitude gain.

The magnitude gain is next modified based on the voice-activity-detector output 21, 22. The method for voice activity detection, according to one embodiment of the invention, is described next.

Voice Activity Detection

Spectral flux measures the speed with which the power spectrum of a signal changes, comparing the power spectrum between adjacent frames of audio. (A frame is multiple blocks of audio data.) Spectral flux indicates voice activity detection or speech-versus-other determination in audio classification. Often, additional indicators are used, and the results pooled to make a decision as to whether or not the audio is indeed speech.

In general, the spectral flux of speech is somewhat higher than that of music, that is to say, the music spectrum tends be more stable between frames than the speech spectrum.

In the case of stereo, where a phantom center channel is extracted, the DFT coefficients are first split into the center and the side audio (original stereo minus phantom center). This differs from traditional mid/side stereo processing in that mid/side processing is typically (L+R)/2, (L−R)/2; whereas center/side processing is C, L+R−2C.

With the signal converted to the frequency domain as previously described, the DFT coefficients are converted to power and then from the DFT domain to the critical-band domain. The critical-band power is then used to calculate the spectral flux of both the center and the side:

$$\tilde{X}_m[p] = \sum_{k=0}^{N-1} [H[k, p]|X_m[k, 2]|^2]^{1/2} \quad (33a)$$

$$0 \le p < P$$

$$\tilde{S}_m[p] = \sum_{k=0}^{N-1} [H[k, p]|X_m[k, 1] + X_m[k, 3] - 2X_m[k, 2]|^2]^{1/2} \quad (33b)$$

$$0 \le p < P$$

where $\tilde{X}_m[p]$ is the critical band version of the phantom center, $\tilde{S}_m[p]$ is the critical band version of the residual signal (sum of left and right minus the center) and H[k,p] are P critical band filters as previously described.

Two frame buffers are created (for the center and side magnitudes) from the previous 2J blocks of data:

$$\overline{X}_{new}(m, p) = \frac{1}{J}\sum_{l=m}^{m-J} \tilde{X}_l[p] \quad (34a)$$

$$\overline{X}_{old}(m, p) = \frac{1}{J}\sum_{l=m-J-1}^{m-2J} \tilde{X}_l[p] \quad (34b)$$

$$\overline{S}_{new}(m, p) = \frac{1}{J}\sum_{l=m}^{m-J} \tilde{S}_l[p] \quad (34c)$$

$$\overline{S}_{old}(m, p) = \frac{1}{J}\sum_{l=m-J-1}^{m-2J} \tilde{S}_l[p] \quad (34d)$$

The next step calculates a weight W for the center channel from the average power of the current and previous frames. This is done over a limited range of bands:

$$W(m) = \sum_{p=P_{start}}^{P_{end}} \frac{|\overline{X}_{new}(m, p)|^2 + |\overline{X}_{old}(m, p)|^2}{P_{end} - P_{start}} \quad (35)$$

$$1 \le P_{start} < P_{end} \le P$$

The range of bands is limited to the primary bandwidth of speech—approximately 100-8000 Hz. The unweighted spectral flux for both the center and the side is then calculated:

$$F_X(m) = \sum_{p=P_{start}}^{P_{end}} |(\overline{X}_{new}(m, p) - \overline{X}_{old}(m, p))|^2 \quad (36a)$$

$$F_S(m) = \sum_{p=P_{start}}^{P_{end}} |(\overline{S}_{new}(m, p) - \overline{S}_{old}(m, p))|^2 \quad (36b)$$

where $F_X(m)$ is the unweighted spectral flux of center and $F_s(m)$ is the un-weighted spectral flux of side.

A biased estimate of the spectral flux is then calculated as follows:

$$\text{if } F_X(m) > F_S(m) \text{ and } W(m) > W_{min} \quad (37a)$$

$$F_{Tot}(m) = \frac{F_X(m) - F_S(m)}{2L \times W(m)} \quad (37b)$$

otherwise, $$F_{Tot}(m) = 0 \quad (37c)$$

where $F_{Tot}(m)$ is total flux estimate, and $W_{min}$ is the minimum weight allowed. $W_{min}$ depends on dynamic range, but a typical value would be $W_{min}$=−60 dB.

A final, smoothed value for the spectral flux is calculated by low pass filtering the values of $F_{Tot}$ (m) with a simple 1st order IIR low-pass filter. This filter depends on the signal's sample rate and block size but, in one embodiment, can be defined by a first-order, low-pass filter with a normalized cutoff of 0.025*fs for fs=48 kHz, where fs is the sample rate of a digital system.

$F_{Tot}(m)$ is then clipped to a range of $0 \le F_{Tot}(m) \le 1$:

$$F_{Tot}(M) = \min\{\max\{0.0, F_{Tot}(m)\}, 1.0\} \quad (38)$$

(The min{ } and max{ } functions limit $F_{Tot}(m)$ to the range of {0, 1} according to this embodiment.)

Mixing

The flattened center channel is mixed with the original audio signal based on the output of the voice activity detector.

The per-bin magnitude gains $Y_m[k]$ for spectral flattening (as shown above) are applied to the phantom center channel $X_m[k,2]$ (as derived above):

$$X_{temp} = Y_m[k]X_m[k,2]$$

$$X_m[k,2] = X_{temp} \quad (39)$$

When the voice activity detector 13 detects speech, let $F_{Tot}(t)=1$; when it detects non-speech, let $F_{Tot}(m)=0$. Values between 0 and 1 are possible, win which case the voice activity detector 13 makes a soft decision on the presence of speech.

For the left channel, $$X_{temp} = (1 - F_{Tot}(m))X_m[k,1] + F_{Tot}(m)X_m[k,2]$$

$$X_m[k,1] = X_{temp}$$

$$0 \le F_{Tot}(m) \le 1 \quad (40a)$$

Similarly, for the right channel, $$X_{temp} = (1 - F_{Tot}(m))X_m[k,3] + F_{Tot}(m)X_m[k,2]$$

$$X_m[k,3] = X_{temp}$$

$$0 \le F_{Tot}(m) \le 1 \quad (40b)$$

In practice, $F_{Tot}$ may be limited to a narrower range of values. For example, $0.1 \le F_{Tot}(m) \le 0.9$ preserves a small amount of both the flattened signal and the original in the final mix.

The per-bin magnitude gains are then applied to the original input signal, which is then converted back to the time domain via the inverse DFT:

$$\hat{x}[mN+n, c] = \frac{1}{N}\sum_{k=0}^{N-1} X_m[k, c]e^{\frac{j2\pi kn}{N}} \quad (41)$$

$$0 \le n < N$$

$$c = 1, 3$$

where $\hat{x}$ is the enhanced version of x, the original stereo input signal.

Figure 4:
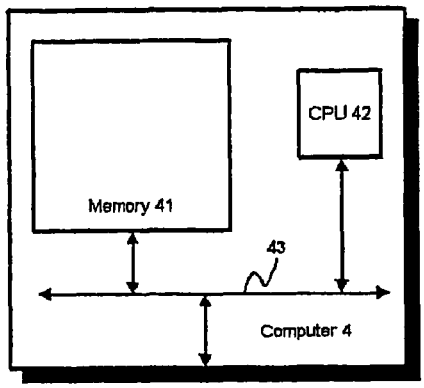
FIG. 4 illustrates a computer system according to one embodiment of the invention.

FIG. 4 illustrates a computer 4 according to one embodiment of the invention. The computer 4 includes a memory 41, a CPU 42 and a bus 43. The bus 43 communicatively couples the memory 41 and CPU 42. The memory 41 stores a computer program for executing any of the methods described above.

A number of embodiments of the invention have been described. Nevertheless, one of ordinary skill in the art understands how to variously modify the described embodiments without departing from the spirit and scope of the invention. For example, while the description includes Discrete Fourier Transforms, one of ordinary skill in the art understands the various alternative methods of transforming from the time domain to the frequency domain and vice versa.

PRIOR ART

Schaub, A. and P. Straub, P., "Spectral sharpening for speech enhancement noise reduction", Proc. ICASSP 1991, Toronto, Canada, May 1991, pp. 993-996.

Sondhi, M., "New methods of pitch extraction", Audio and Electroacoustics, IEEE Transactions, June 1968, Volume 16, Issue 2, pp 262-266.

Villchur, E., "Signal Processing to Improve Speech Intelligibility for the Hearing Impaired", 99th Audio Engineering Society Convention, September 1995.

Thomas, I. and Niederjohn, R., "Preprocessing of Speech for Added Intelligibility in High Ambient Noise", 34th Audio Engineering Society Convention, March 1968.

Moore, B. et. al., "A Model for the Prediction of Thresholds, Loudness, and Partial Loudness", J. Audio Eng. Soc., Vol. 45, No. 4, April 1997.

Moore, B. and Oxenham, A., "Psychoacoustic consequences of compression in the peripheral auditory system", The Journal of the Acoustical Society of America—December 2002-Volume 112, Issue 6, pp. 2962-2966

Spectral Flattening

US Patents

U.S. Pat. No. 6,732,073 B1 Spectral enhancement of acoustic signals to provide improved recognition of speech U.S. Pat. No. 6,993,480 B1 Voice intelligibility enhancement system US 2006/0206320 A1 Apparatus and method for noise reduction and speech enhancement with microphones and loudspeakers U.S. Pat. No. 7,191,122 Speech compression system and method US 2007/0094017 Frequency domain format enhancement

International Patents

WO 2004/013840 A1 Digital Signal Processing Techniques For Improving Audio Clarity And Intelligibility WO 2003/015082 Sound Intelligibility Enhancement Using A Psychoacoustic Model And An Oversampled Filterbank

Papers

Sallberg, B. et. al; "Analog Circuit Implementation for Speech Enhancement Purposes Signals"; Systems and Computers, 2004. Conference Record of the Thirty-Eighth Asilomar Conference.

Magotra, N. and Sirivara, S.; "Real-time digital speech processing strategies for the hearing impaired"; *Acoustics, Speech, and Signal Processing,* 1997. ICASSP-97., 1997 page(s): 1211-1214 vol. 2

Walker, G., Byrne, D., and Dillon, H.; "The effects of multichannel compression/expansion amplification on the intelligibility of nonsense syllables in noise"; The Journal of the Acoustical Society of America—September 1984—Volume 76, Issue 3, pp. 746-757

Center Extraction

Adobe Audition has a vocal instrument extraction function http://www.adobeforums.com/cgi-bin/webx/.3bc3a3e5

"center cut" for winamp http://www.hydrogenaudio.org/forums/lofiversion/index.php/t17450.html

Spectral Flux

Vinton, M, and Robinson C; "Automated Speech/Other Discrimination for Loudness Monitoring," AES118th Convention. 2005

Scheirer E., and Slaney M., "Construction and evaluation of a robust multifeature speech/music discriminator", IEEE Transactions on Acoustics, Speech, and Signal Processing (ICASSP'97), 1997, pp. 1331-1334.

The invention claimed is:

1. A method for enhancing speech, the method being performed by one or more computing devices, the method comprising:

extracting a center channel of an audio signal with multiple channels including a first channel and a second channel to produce an extracted center channel, wherein the extracting is performed by the one or more computing devices and comprises:

obtaining an assumed center channel from a sum of the first channel and the second channel;

calculating a product by multiplying the first channel, less a proportion of the assumed center channel, with a conjugate of the second channel, less the proportion of the assumed center channel;

obtaining an extraction coefficient from a value of the proportion of the assumed center channel that makes the product approximate to zero; and obtaining the extracted center channel by multiplying the assumed center channel by the extraction coefficient;

generating a confidence in detecting speech in the extracted center channel;

flattening a spectrum of the extracted center channel to produce a flattened center channel; and mixing the flattened center channel with the audio signal proportionate to the confidence of having detected speech, thereby enhancing speech in an output audio signal.

2. The method of claim 1, wherein the confidence varies from a lowest possible probability to a highest possible probability, and the generating comprises further limiting the generated confidence to a value higher than the lowest possible probability and lower than the highest possible probability.

3. The method of claim 1, wherein flattening the spectrum of the extracted center channel comprises:

separating a presumed speech channel into perceptual bands, determining which of the perceptual bands has a highest energy, and increasing a gain of perceptual bands with less energy, thereby flattening the spectrum of the speech in the output audio signal.

4. A non-transitory storage medium that records a computer program for executing the method of any one of claims 1, 2 and 3.

5. A computer system comprising:

a CPU;

a non-transitory storage medium that records a computer program for executing the method of any one of claims 1, 2 and 3; and a bus coupling the CPU and the storage medium.

6. A speech enhancing apparatus, comprising:

a central processing unit (CPU) configured for extracting a center channel of an original audio signal with multiple channels including a first channel and a second channel according to a process that involves:

obtaining an assumed center channel from a sum of the first channel and the second channel;

calculating a product by multiplying the first channel, less a proportion of the assumed center channel, with a conjugate of the second channel, less the proportion of the assumed center channel;

obtaining an extraction coefficient from a value of the proportion of the assumed center channel that makes the product approximate to zero; and obtaining the extracted center channel by multiplying the assumed center channel by the extraction coefficient, wherein the CPU is further configured for:

flattening a spectrum of the center channel to produce a flattened center channel;

generating a confidence in detecting speech in the center channel; and mixing the flattened center channel with the original audio signal proportionate to the confidence of having detected speech, thereby enhancing the speech in a resulting audio signal.

7. The speech enhancing apparatus of claim 6, wherein the CPU is configured for:

separating a presumed speech channel into perceptual bands, determining which of the perceptual bands has a highest energy, and increasing a gain of perceptual bands with less energy, thereby flattening the spectrum of the speech in the output audio signal.

* * * * *